US007458852B2

(12) United States Patent
Gunreben

(10) Patent No.: US 7,458,852 B2
(45) Date of Patent: Dec. 2, 2008

(54) PLUG CONNECTOR AND METHOD FOR PREASSEMBLY THEREOF

(75) Inventor: Michael Gunreben, Burgthann (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/595,127

(22) Filed: Nov. 9, 2006

(65) Prior Publication Data

US 2007/0105442 A1 May 10, 2007

Related U.S. Application Data

(63) Continuation of application No. PCT/EP2005/005170, filed on May 12, 2005.

(30) Foreign Application Priority Data

May 12, 2004 (DE) ..... 10 2004 023 446

(51) Int. Cl.
*H01R 13/40* (2006.01)

(52) U.S. Cl. ..... 439/596

(58) Field of Classification Search ..... 439/595, 439/596, 701, 597, 599
See application file for complete search history.

(56) References Cited

U.S. PATENT DOCUMENTS

| | | | | |
|---|---|---|---|---|
| 5,575,681 | A | 11/1996 | Muzslay et al. | 439/459 |
| 5,716,235 | A | 2/1998 | Endo et al. | 439/596 |
| 5,860,834 | A * | 1/1999 | Sugiyama | 439/595 |
| 5,888,103 | A | 3/1999 | Norizuki et al. | 439/701 |
| 6,176,740 | B1 | 1/2001 | Abe et al. | 439/596 |
| 2003/0139094 | A1 * | 7/2003 | Venditti et al. | 439/596 |

FOREIGN PATENT DOCUMENTS

| | | |
|---|---|---|
| DE | 198 04 170 A1 | 8/1999 |
| EP | 0 333 394 | 9/1989 |
| EP | 0 579 884 A1 | 1/1994 |
| EP | 0 986 146 A1 | 3/2000 |
| EP | 1 150 389 A1 | 10/2001 |

* cited by examiner

*Primary Examiner*—Ross N Gushi
(74) *Attorney, Agent, or Firm*—Harrington & Smith, PC

(57) ABSTRACT

The invention relates to a plug connector with contacts having a connecting end for a cable, a housing and a lid. The housing and the lid each have a flap at the level of the connecting end of the contacts, wherein the connecting ends of the contacts can be freely accessed when said flap is in its open position in order to fasten the cable.

19 Claims, 7 Drawing Sheets

PLUG CONNECTOR AND METHOD FOR PREASSEMBLY THEREOF

CROSS-REFERENCE TO RLELATED APPLICATION

Figure 1:
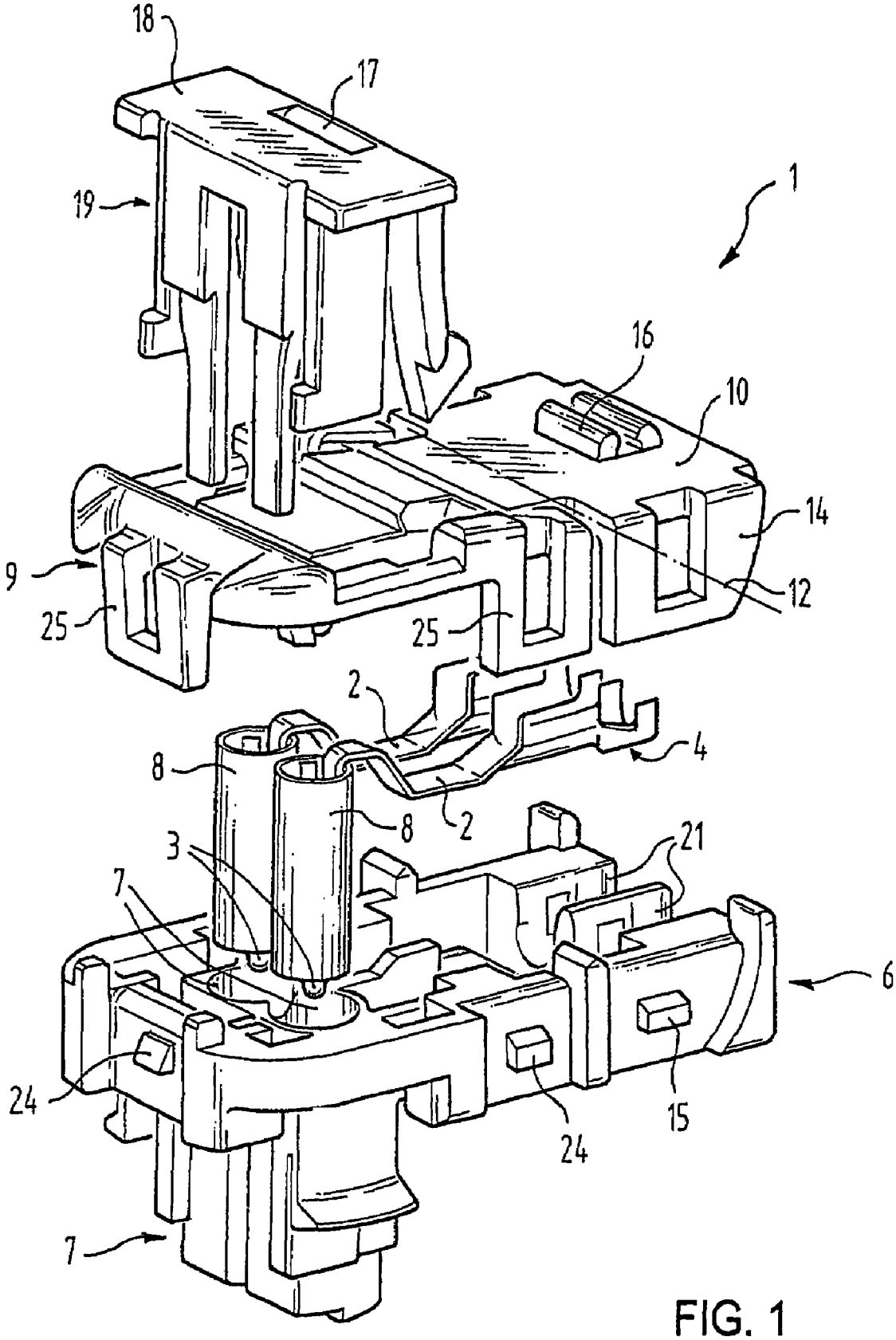

This application is a continuation of International Patent Application No. PCT/EP2005/005170 filed May 12, 2005.

The present invention relates to a plug connector with contacts, each having a connecting end for a cable, as well as a housing and a lid. Such a plug connector is known, for example, from DE 101 46 430 A1, as well as a method for the preassembly thereof.

This publication describes a plug connector for airbag systems with a housing on which is disposed a plug part angled by 90° and around which are arranged the plug contacts and electronic components for protection against EMI influences. The housing part is closed by a lid which is fastened by locking on the housing, through which a U shaped yoke portion of a secondary lock engages in the plug part. Such a plug connector is delivered in individual parts to suppliers of the automobile industry who are responsible for the production of wire harnesses (harness makers), so that they can wire the contacts and then assemble them and deliver them to the customer. When these plug connectors are assembled, errors may crop up and it is not worthwhile for the harness maker to want to automate this procedure, since for him, this plug connector is only one of many which is used in specific wirings.

The object of the present invention is thus to further develop a plug connector of the given design so that it can be delivered in a preassembled state, and the wiring of the plug connector can be carried out without need to open up the entire assembly. This object is solved according to the claims.

Features of preferred embodiments of the present invention are characterized in the subclaims.

The plug connector according to the invention has the advantage that all of its components, such as contacts, ferrite cores, secondary locking yoke, housing and lid are solidly joined together when the plug connector is taken for connecting to the cable. This connection is preferably performed by crimping. This process is suitable for automating, which saves time and is cost-effective.

Figure 2B:
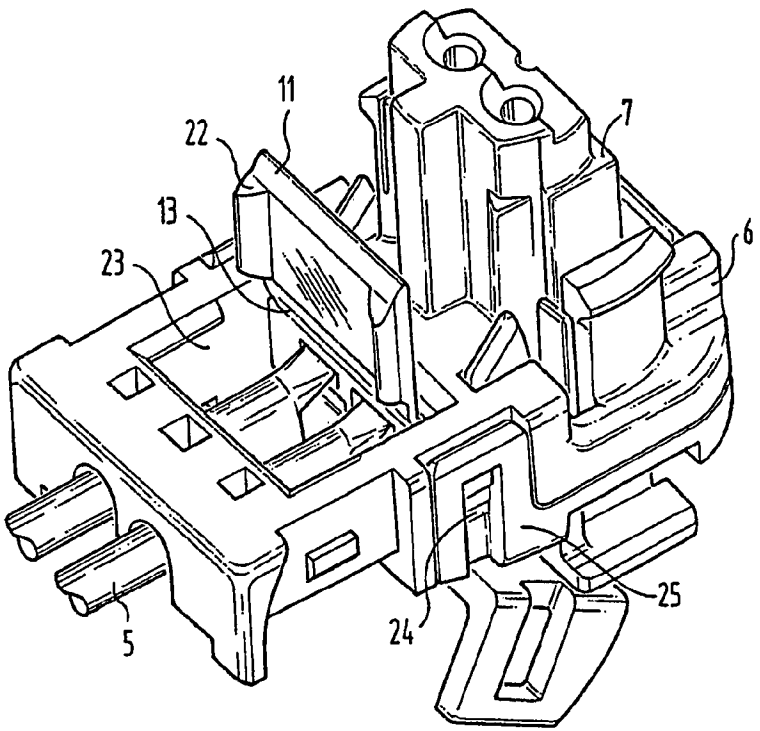
Figure 2A:
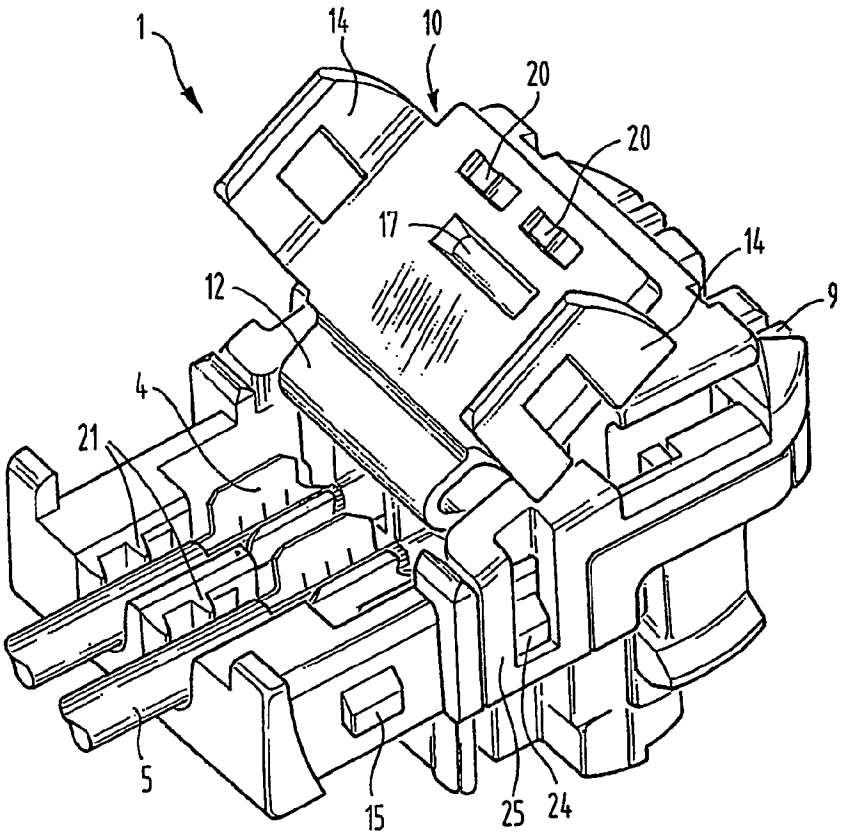

The invention will be explained in more detail in the following, based on the description of an example of embodiment, with reference to the drawing. The following are shown therein:

FIG. 1 an exploded drawing of the plug connector according to the invention; and FIGS. 2(*a*), (*b*) perspective views of the plug connector according to the invention from the top and from the bottom.

Figure 3A:
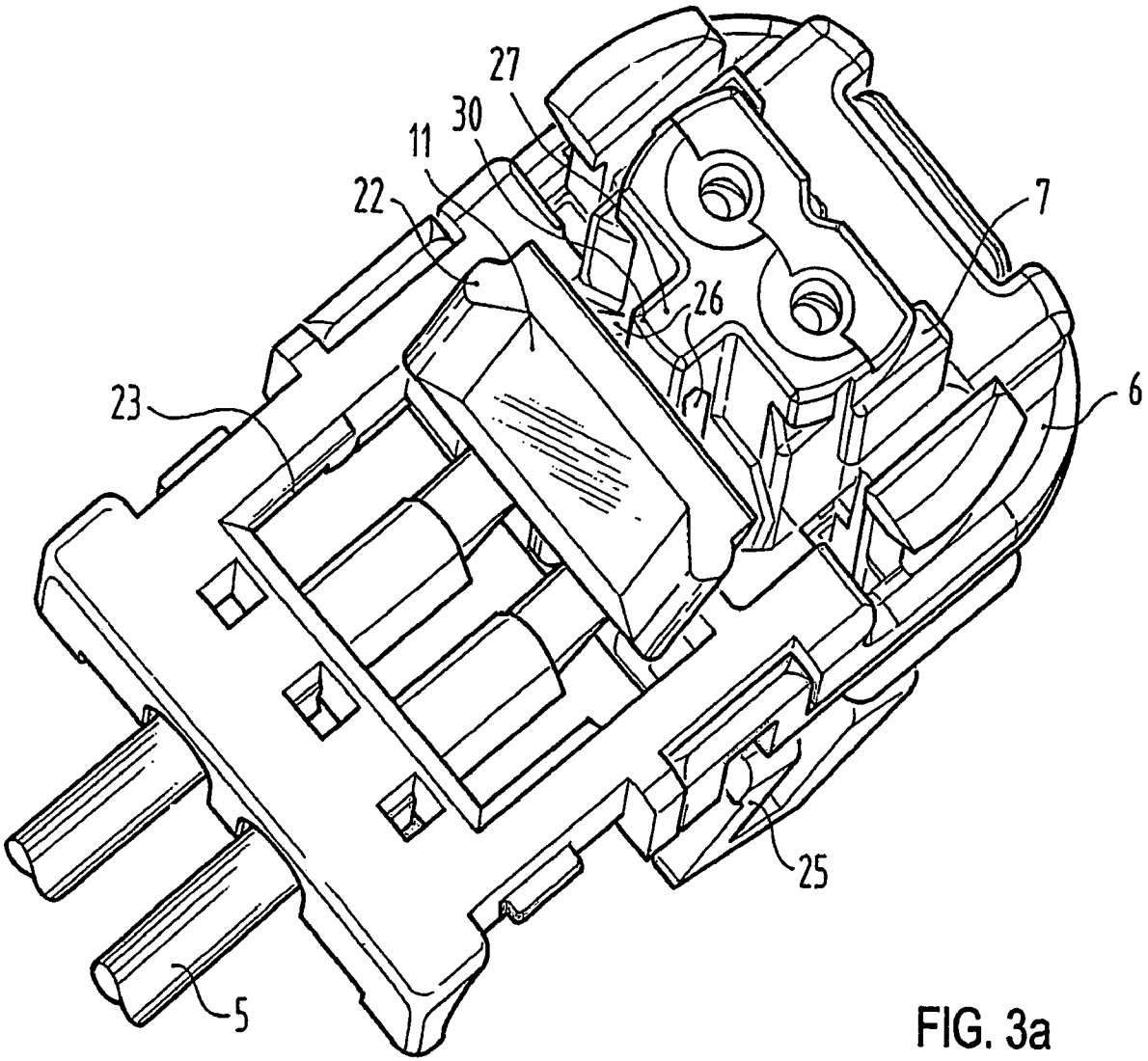
Figure 3B:
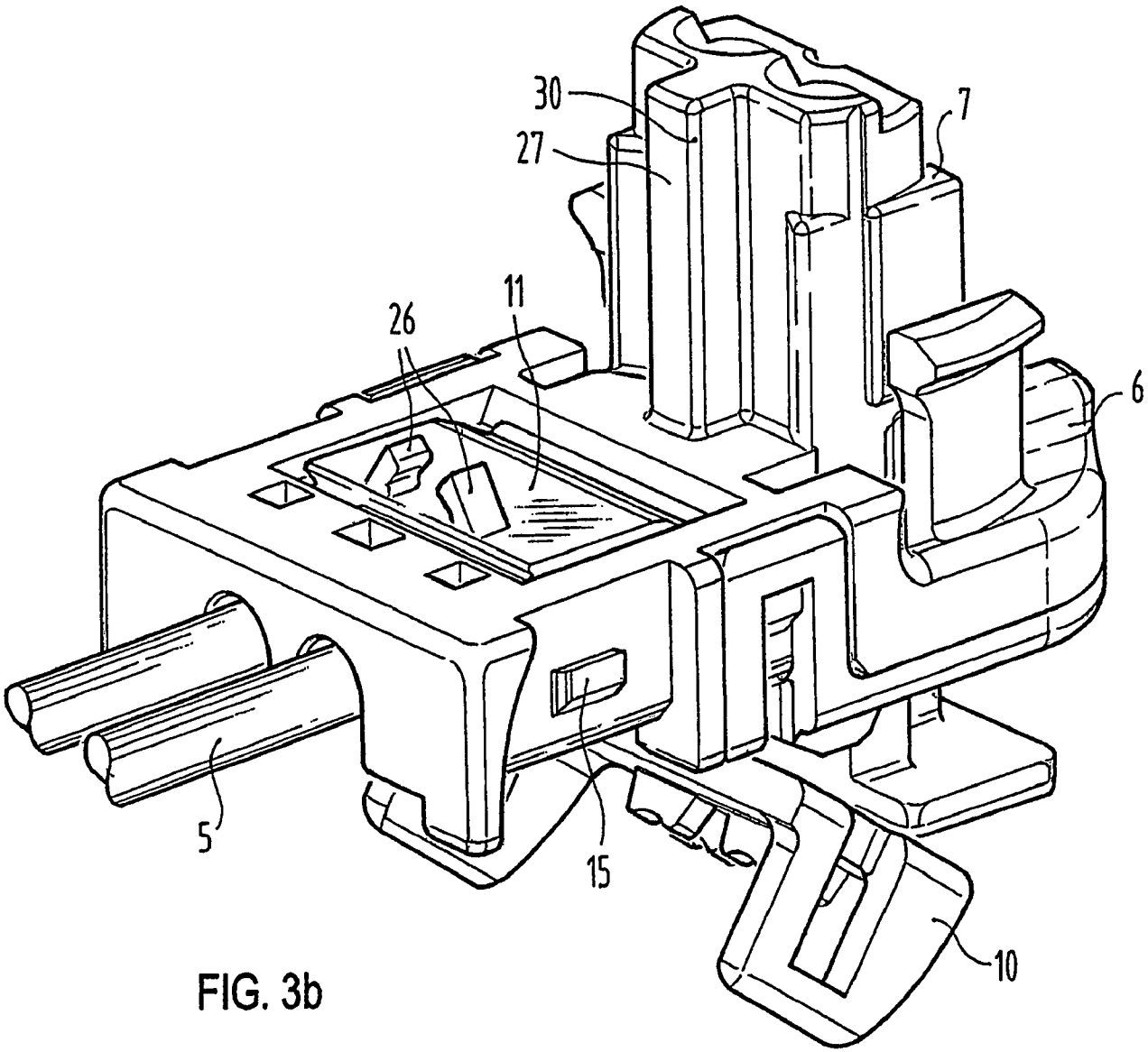
Figure 4A:
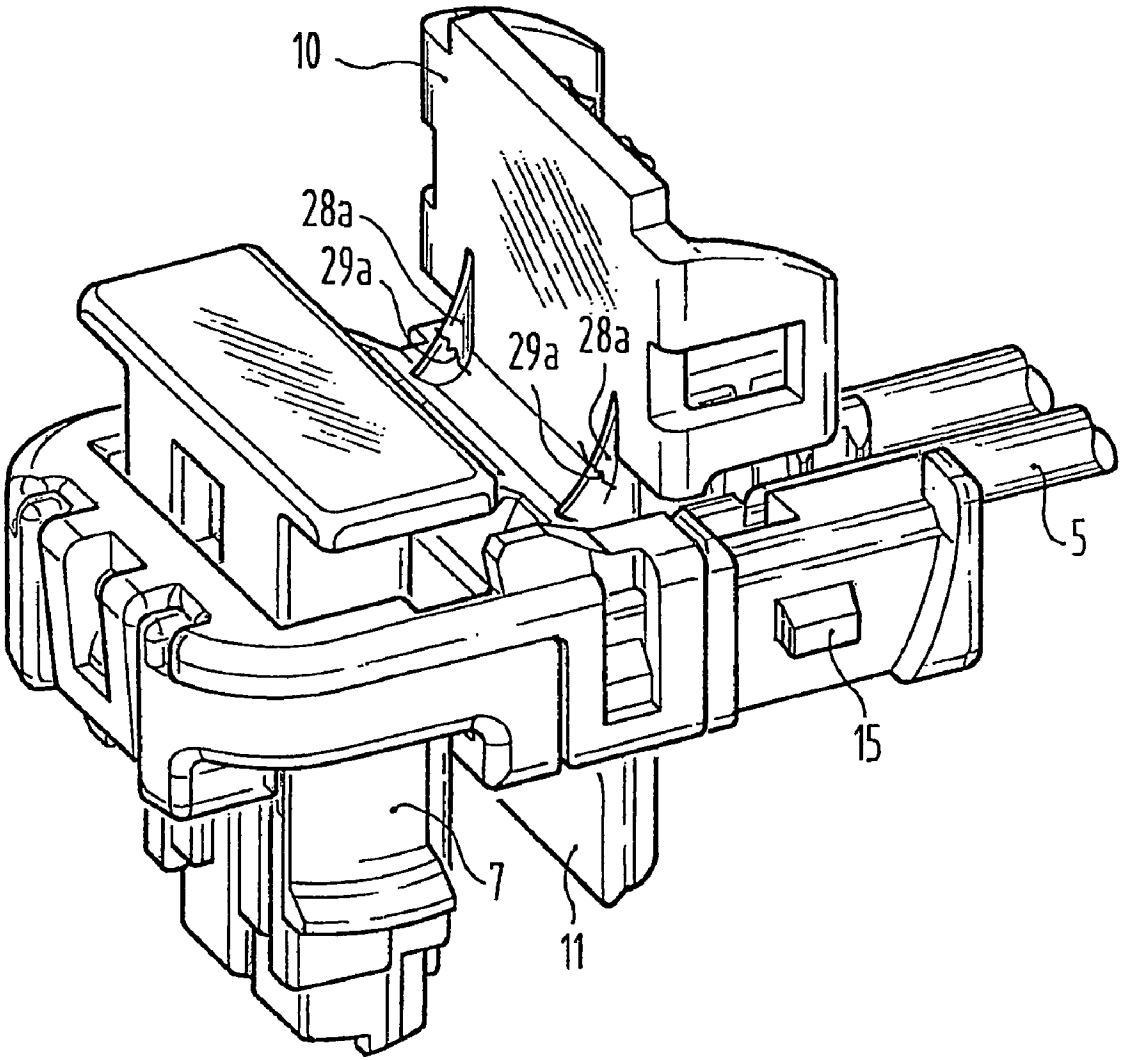
Figure 4B:
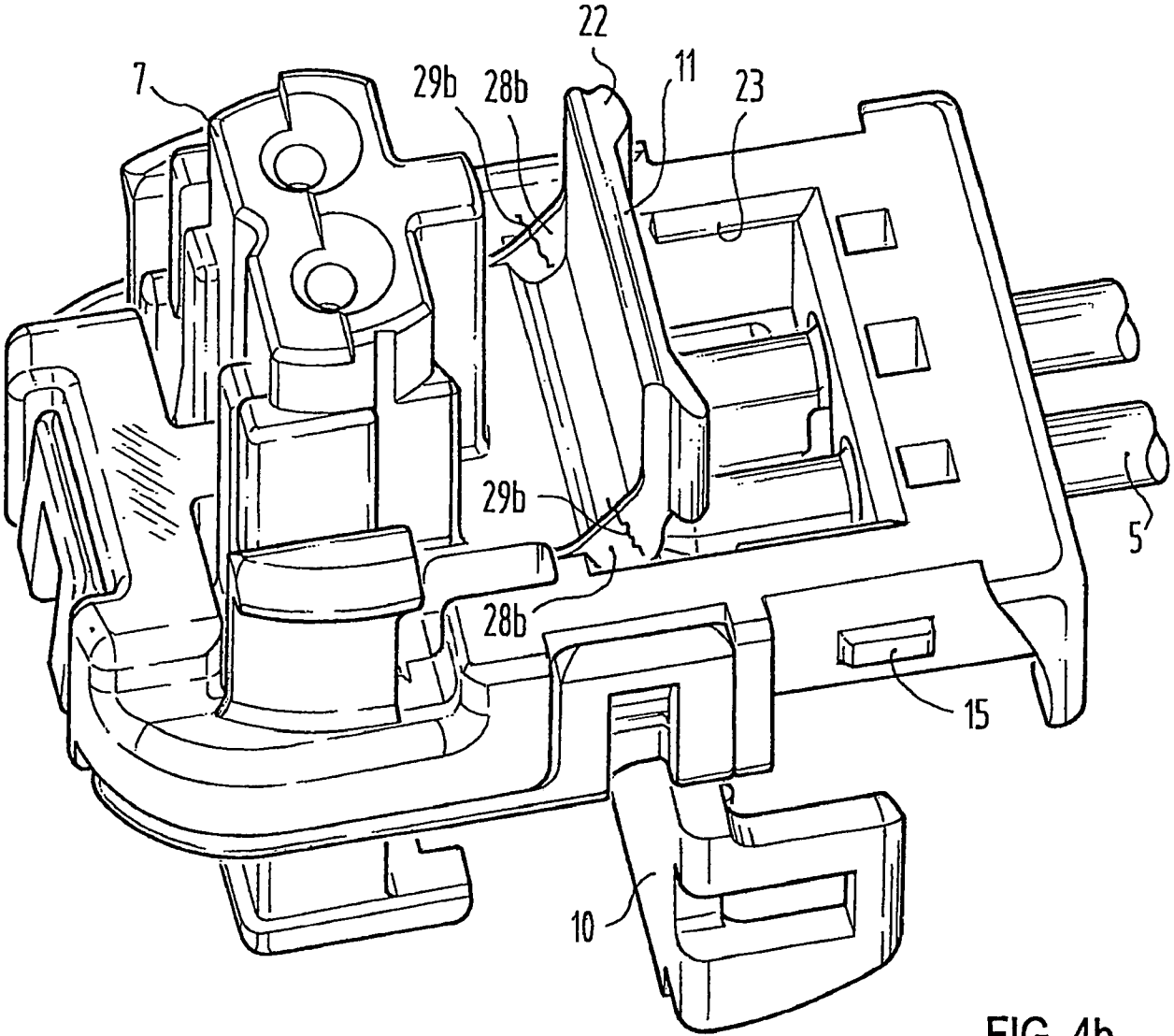
Figure 5:
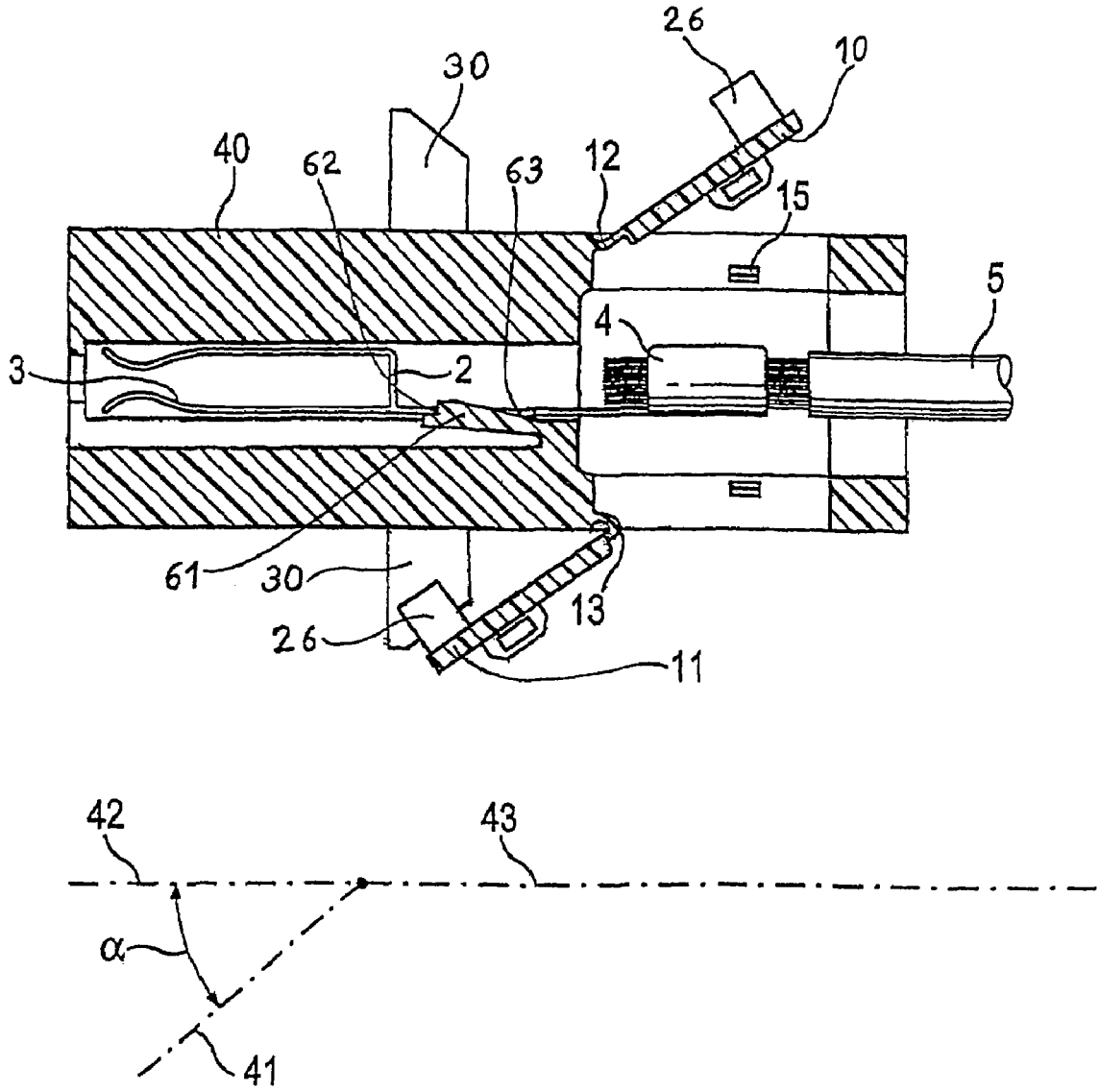

FIG. 3(*a*) a perspective view of the underside of the plug connector according to FIG. 2(*b*) with a retaining-clamping device for the lower flap;

FIG. 3(*b*) the plug connector from FIG. 3(*a*) with closed flap;

FIG. 4(*a*) an alternative embodiment of a retaining element for the upper flap;

FIG. 4(*b*) an alternative embodiment of a retaining element for the lower flap;

FIG. 5 another embodiment of the plug connector.

FIG. 1 shows the components of a plug connector 1 according to the invention, listed from bottom to top as follows: a housing 6 with a plug part 7 takes up contacts 2, including the ferrite elements 8 thereof. The housing 6 is closed by a lid 9, through which a U shaped yoke 18 of a secondary lock 19 engages. The secondary lock 19 has two locking positions, an assembly position and a final position, in which it locks the connection between the plug connector and the ignition device of an airbag system.

Contacts 2 have a plug or socket end 3 and a rear connecting end 4 for the connection with connecting cables 5. Lid 9 is fastened onto housing 6 by the locking of catch brackets 25 with catch pieces 24. All of the internal components of the plug connector are secured in their position by locking the lid 9 onto housing 6.

In FIG. 2(*a*), the left part of lid 9 has a flap 10, which can be swung up toward the top around axis 12. The swiveling axis is formed by providing the lid which is an injection molded plastic part, with a smaller material thickness in this region, so that the upper flap 10 can be swiveled around this thinner part of the material. In the closed position, the upper flap 10 locks by catch brackets 14 on corresponding catch pieces 15 on housing 6. Catch elements 16, which can snap together with corresponding catch elements 17 on the opposite-lying edge of yoke 18 of secondary lock 19, are introduced on the upper side of the flap 10, whereby both the position of yoke 18 of secondary lock 19 and the open position of upper flap 10 are fixed. A similar fastening of flap (11) is possible on housing (H) (not shown here).

FIG. 2(*a*) shows the plug connector 1 according to the invention obliquely from the top with opened upper flap 10. It can be recognized that the cable connecting ends 4 of contacts 2 are freely accessible from the top when upper flap 10 is opened. FIG. 2 (*b*) shows the plug connector from below, also with opened lower flap 11, so that the connection region 4 of contacts 2 is also freely accessible on the bottom. The possibility of performing the wiring, preferably by crimping, is created in this way for the otherwise completely assembled and closed plug connector. For this purpose, the plug connector is placed on a crimping anvil (not shown) with opened flaps 10 and 11 and the cable connecting ends of contacts 2 are deformed by a crimping tool from the opposite side.

In this position, the ferrite cores and the secondary lock 19 as well as contacts 2 are rigidly secured, so that irregularities cannot occur here. The protective sheaths of cable 5 are pressed into strain relief pieces 21, which secure the cable by means of teeth engaging in the sheath material. In order to press cables 5 more solidly into strain relief 21, molded pieces 20 are formed on the bottom side of flap 10, and these pieces press cables 5 more solidly into strain relieves 21 when flap 10 is locked.

As can be recognized in FIG. 2(*b*), the lower flap 11 of housing 6 is locked by catch shoulders 22, which are formed on the lateral walls of lower flap 11 and which are locked into corresponding grooves 23 formed on the lateral walls of housing 6. The lower flap 11 can also be swiveled around a swiveling axis 13 via a thinning of the material.

FIGS. 3(*a*) and 3(*b*) show an alternative retaining-clamping device for lower flap 11.

Here, clamps 26 lying opposite each other are disposed on the top side of lower flap 11, and when they are in the open state, these clamps engage behind ribs 30, which are disposed along one edge of a profile running in the plug-in direction. In this way, it is assured that lower flap 11 is securely held open, e.g., during a bending procedure. FIG. 3(*b*) shows the closed flap 11.

FIGS. 4(*a*) and 4(*b*) show another alternative retaining element for the lower and upper flaps. Here, during injection molding, when flaps 10, 11 are each opened approximately 90°, retaining ribs 28*a*, 28*b* are cast on between the housing or the lid and the respective flap 10 or 11 belonging to the housing or the lid, and these will break at predetermined breaking points 29*a* or 29*b*, respectively, as soon as one attempts to close these flaps with force. Then the flaps are released.

After the cable ends have been successfully crimped with the connecting ends 4 of contacts 2, flaps 10 and 11 are closed and locked. The plug connector can thus be used directly at its application site, whereby yoke 18 of secondary lock 19 is locked in a preassembly position and can be transferred into its final locking position by further pressing in at the application site, whereby the plug connector is definitively locked.

FIG. 5 shows schematically in section another embodiment of the invention, wherein the same reference numbers designate the same features of the invention given previously. The embodiment of FIG. 5 differs from the previous embodiments by the fact that housing 6 and lid 9 are not provided separately, but rather there is an uptake 40, which surrounds the connecting ends 4 of the contacts and preferably also the plug or socket ends 3 of contacts 2 lying in front (at the left in FIG. 5) and which has two openings on the two sides of connecting ends 4 of contacts 2, in the same way as the combination of housing 6 and lid 9. At least one of the openings, and preferably both, can be closed by flaps 10 and 11. The structure, function and application thereof are the same as described above relative to FIGS. 1 to 4. The locking of the flaps and the other features of the plug connector may also be designed as described previously. Uptake 40 can be formed in one piece.

The sketch at the bottom of FIG. 5 explains the angle positions of the effective directions of the plug or socket ends 3 and connecting ends 4 of contacts 2. The plug or socket ends 3 of contacts 2 in the embodiment of FIG. 5 may run in a direction 41, which is angled at an angle $\alpha$ of less than 90°, in particular less than 60°, and preferably less than 20°, relative to extension 42 of the direction 43 of connecting ends 4. In FIG. 5, the direction of the plug or socket ends 3 lies in the extension of the direction 43 of connecting end 4 and thus forms a 180° angle with it ($\alpha$=0°). In the embodiments of FIGS. 1 to 4, $\alpha$ preferably amounts to 70° to 110°, more preferably 90°.

During assembly, contacts 2 are first inserted into uptake 40. This can be done by displacing the contacts in the longitudinal direction of FIG. 5, thus either from the left, or preferably from the right. If the geometric ratios permit it or if they are configured by angling from the region on the left relative to that on the right, the contacts can be inserted also through one of the windows that can be closed by flaps 10, 11. Then cable ends 5 can be fastened to connecting ends 4 of contacts 2 by crimping or soldering and then closing flaps 10, 11.

In general, as shown in FIG. 5, a fastening device may be provided in order to secure or fasten a contact to housing 6 and/or lid 9, or optionally uptake 40, to prevent it from being displaced after the assembly thereof. A fastening device can provide a tab 61 which projects inside toward the front of housing 6 or lid 9, or uptake 40, this tab hooking behind a projection or an edge 62 of contact 2, for example the edge of a punched opening 63, when contact 2 is inserted into housing 6 and/or lid 9, or optionally uptake 40, so that backward displacement of contact 2 is prevented once it has been inserted during assembly. A stop can be provided toward the front for the contact that is being inserted or for a surface or edge formed thereon.

In general, one or more of flaps 10, 11 may have a catch device 26, 30, with which flaps 10, 11 can be arrested in the open position, so that they are retained in a defined, open position when contact 2 is connected to cable 5, so that the flaps do not disrupt the assembly process. One flap 10, 11 can be locked in the open position with the catch device, in a manner that is reversible, on a suitably configured region of housing 6 and/or lid 9, or uptake 40. The catch device may have a hook or a clamping device.

The preceding description of an example of embodiment of the present invention is not to be understood as limiting, but serves only for illustration of the invention defined in the claims. Various alternative techniques for fastening the cable ends to the connecting ends of the contacts are possible, for example, without departing from the invention. Thus it is also possible, for example, to produce a joining by means of soldering instead of crimping.

The invention claimed is:

1. A plug connector, having contacts, each with a connecting end for a cable, wherein the connecting end comprises a first side and an opposite second side, a housing comprising a first opening and a second opening, wherein the first opening is proximate the first sides of the connecting ends, and wherein the second opening is proximate the second sides of the same connecting ends, and a lid, is hereby characterized in that the housing and the lid each have a flap at the level of the connecting end of contact, when the flaps are in a closed position, the flap of the housing is at the first opening and the flap of the lid is at the second opening, and when these flaps are in the open position, the connecting ends of contacts are freely accessible for fastening the cable, wherein the first side of the connecting end is configured to contact a first portion of a tool proximate the first opening, wherein the second side of the connecting end is configured to be deformed by a second portion of the tool proximate the second opening, and wherein the contacts are fully engaged in the housing when the flaps are in the open position.

2. The plug connector according to claim 1, further characterized in that the housing and the lid are made of plastic, and the flaps are linked by hinges of thinner material to each of the former, respectively.

3. The plug connector according to claim 1, further characterized in that the flap of the lid has catch brackets laterally on both sides of the lid and these brackets lock with corresponding catch pieces on the lateral walls of the housing in the closed position of the flap of the lid.

4. The plug connector according to claim 1, further characterized in that the flap of the lid has catch elements on a top side of the lid, which can be locked with complementary catch elements when the flap of the lid is in the open position.

5. The plug connector according to claim 4, further characterized in that the upper flap on aid has catch elements on its top side, which can be locked with complementary catch elements on a yoke of a secondary lock when flap is in the open position and when yoke is in the assembly position.

6. The plug connector according to claim 1, further characterized in that flap on lid has molded pieces, which press the cable ends mounted on the back end of housing in strain relief into this relief when lid is locked.

7. The plug connector according to claim 1, further characterized in that flap on housing has catch shoulders on its lateral edges running perpendicular to swiveling axis, and these shoulders lock in corresponding grooves in housing.

8. The plug connector according to claim 1, further characterized in that the cable ends, stripped of insulation, are joined with contacts by crimping, whereby crimping is conducted with the complete assembled plug connector and opened flaps.

9. The plug connector according to claim 1, further characterized in that lid and housing are fastened via lateral catch shoulders/catch arms either to one another or to a part of lid.

10. The plug connector according to claim 1, further characterized in that flaps are arrested in open position by retaining ribs with predetermined breaking points at the joining edges between housing or lid and flaps, respectively, which stand open.

11. The plug connector according to claim 1, further characterized in that the lower flap is arrested on housing in open position by means of a reversible locking between catch elements on flap and complementary catch elements on the housing.

12. A method for the preassembly of a plug connector according to claim 1 is hereby characterized by the combination of the following steps:

a) inserting contacts into housing;

b) fastening lid on the housing, with opened flaps;

c) fastening cable ends to the connecting ends of contacts by crimping or soldering; and d) closing flaps.

13. A plug connector, having contacts, each with a connecting end for a cable, wherein the connecting end comprises a top side and an opposite bottom side, an uptake, which surrounds the connecting ends of contacts, is hereby characterized in that the uptake has an opening at the top side and an opening at the bottom side of the connecting ends at the level of connecting end of contact, and at least one of these openings can be closed by a flap, in the open position of which, the connecting ends are freely accessible for the fastening of cable, wherein the opening at the top side is configured to allow for deformation of the top side by a crimping tool, and wherein the opening at the bottom side is configured to allow for the bottom side to contact a crimping anvil.

14. The plug connector according to claim 13, further characterized in that uptake can be formed in one piece.

15. The plug connector according to claim 13, further characterized in that uptake also surrounds the plug or socket ends of contacts.

16. The plug connector according to claim 13, further characterized in that the uptake has two flaps for closing both openings.

17. The plug connector according to claim 1, further characterized by a catch device for the reversible retaining of one flap in the open state.

18. The plug connector according to claim 13, further characterized by a catch device for the reversible retaining of one flap in the open state.

19. A plug connector comprising;

a housing comprising a first opening and an opposite second opening;

a lid attached to the housing, wherein the lid is configured to cover the second opening; and a contact between the housing and the lid, wherein the contact comprises a connecting end, wherein a first side of the connecting end is accessible through the first opening, wherein the first opening is configured to allow a crimping anvil to extend therethrough and contact the first side, wherein an opposite second side of the connecting end is accessible proximate the second opening, and wherein the second side is configured to be deformed by a tool.

* * * * *